US007431057B2

(12) United States Patent
Ryan

(10) Patent No.: US 7,431,057 B2
(45) Date of Patent: Oct. 7, 2008

(54) PAINTBALL FILLING SYSTEM AND METHOD

(76) Inventor: John Ryan, 31272 Calle San Pedro, San Juan Capistrano, CA (US) 92675

( * ) Notice: Subject to any disclaimer, the term of this patent is extended or adjusted under 35 U.S.C. 154(b) by 378 days.

(21) Appl. No.: 11/270,261

(22) Filed: Nov. 9, 2005

(65) Prior Publication Data

US 2007/0113915 A1 May 24, 2007

(51) Int. Cl.

| | |
|---|---|
| ***B65B 39/00*** | (2006.01) |
| ***B65B 1/04*** | (2006.01) |
| ***F41F 1/00*** | (2006.01) |
| ***G07F 11/00*** | (2006.01) |

(52) U.S. Cl. ..... 141/344; 141/21; 141/88; 141/243; 124/41.1; 221/174

(58) Field of Classification Search ..... 141/2, 141/18, 331, 88, 237, 243, 344; 221/174; 414/266–269; 124/48, 41.1

See application file for complete search history.

(56) References Cited

U.S. PATENT DOCUMENTS 6,722,355 B1 * 4/2004 Andrews, Jr. ..... 124/49
6,824,011 B1 * 11/2004 Woempner ..... 221/265
6,843,399 B2 1/2005 Garcia
6,845,794 B2 1/2005 Johnson
2003/0222095 A1 * 12/2003 Santangini et al. ..... 221/174
2004/0149275 A1 * 8/2004 Vincent ..... 124/41.1

OTHER PUBLICATIONS

Internet article from pbreview.com of The Paintball Rocket, printed on Aug. 26, 2005; 5 pages.
Internet article from ActionVillage of AJP Paintball Podloader, printed on Aug. 26, 2005; 6 pages.
Internet article from ActionVillage of DX2 Paintall Caddy, printed on Aug. 26, 2005; 7 pages.
Internet article from ActionVillage of Paintball Creations Podrack, printed on Aug. 26, 2005; 4 pages.

* cited by examiner

*Primary Examiner*—Timothy L. Maust
*Assistant Examiner*—Nicolas A Arnett
(74) *Attorney, Agent, or Firm*—Knobbe, Martens, Olson & Bear, LLP

(57) ABSTRACT

A system for simultaneously filling a plurality of paintball pods with a reduced incidence of spilling includes a housing, a pod support, a reservoir, and a valve. The pod support includes a plate with at least one aperture configured to maintain at least one paintball pod in a vertical orientation. The pod support is configured to be positioned in the housing. The reservoir includes at least one opening in a bottom wall thereof. The valve selectively and controllably allows or obstructs a flow of paintballs from the reservoir to one or more paintball pods positioned in the pod support. The components of the paintball filling system may be coupled or nested into a single transportable unit.

5 Claims, 4 Drawing Sheets

PAINTBALL FILLING SYSTEM AND METHOD

BACKGROUND OF THE INVENTION

1. Field of the Invention

The invention relates generally to paintball filling systems, and, more specifically, to a system for refilling multiple paintball pods simultaneously.

2. Description of the Related Art

In the sport of paintball, players use gas-powered guns to shoot water-soluble paint-filled capsules at each other. Paintball games may take a variety of forms including warfare simulation among two adversarial teams, or modified versions of traditional games such as capture the flag. Modem paintball guns have high repeat firing rates, allowing a player to shoot multiple paintballs at an opponent in a short span of time. The combination of high firing rates with inaccurate, sometimes unpredictable, trajectories taken by the paintballs often results in hundreds of paintballs being expended by each player during a paintball game.

To reduce the chances of running out of paintball ammunition during a game, players typically carry several paintball pods or tubes each containing from 100-200 paintballs. These pods can be opened and emptied into a hopper on a player's gun as necessary during the game. While the paintball pods offer convenient reloading of the gun during an ongoing game, the pods themselves have proven quite cumbersome and difficult to reload. Many players attempt to load the pods by hand one handful of paintballs at a time. Others attempt to pour the paintballs through a hole cut in the plastic bag in which the paintballs were packaged for sale. Both of these methods are cumbersome and inefficient. It can also be time consuming because only one pod is refilled at a time. The cumbersome nature of the conventional paintball pod filling techniques often results in many dropped paintballs. Dropped paintballs are typically discarded for fear of contaminating and prematurely wearing the shooting mechanism of a paintball gun. Therefore, dropped paintballs often represent a significant wasted expenditure by a paintball player. Often a team that is able to refill quickly in a paintball game has a distinct advantage.

Several paintball pod filling devices have been proposed to improve reloading of paintball pods and reduce the incidence of spilled paintballs. However, these devices have all had significant shortcomings. Most of these devices are essentially funnels having a spout designed to fit a single paintball pod. Since only a single paintball pod may be filled with one of these devices, filling several paintball pods is still a time consuming affair as each pod must be filled separately. Also, each disconnection of a pod from the funnel is an opportunity for paintball spillage from either the newly-filled pod or from the funnel. Multiple spout funnels to fill multiple paintball pods simultaneously have also been attempted. While the multiple-spout configuration may allow simultaneous filling of multiple paintball pods, no mechanism exists to stop the flow of paintballs from the funnels once the pods have been filled. Thus, these multiple spout configurations are especially prone to paintball spillage when the funnel is removed from paintball pods. Therefore, there remains a need for a paintball filling system capable of quickly filling one or more paintball pods simultaneously with a greatly reduced risk of paintball spillage.

SUMMARY OF THE INVENTION

In various embodiments as discussed further below, paintball filling systems and methods of use are provided that overcome the shortcomings of the devices disclosed above. Specifically, paintball filling systems are disclosed herein that are capable of filling multiple paintball pods simultaneously with little risk of spillage. In certain embodiments, the paintball filling systems include a reservoir having a plurality of openings on a bottom wall thereof. The openings are selectively controllable between an open state in which a flow of paintballs may pass through the holes and a closed state in which the holes are at least partially obstructed to block the flow of paintballs. The openings are alignable with a plurality of apertures on a pod support configured to maintain a plurality of pods in a substantially vertical orientation. The pod support may be positioned in a housing that can be coupled with the reservoir. By coupling the reservoir and the housing so that the openings of the reservoir are aligned with the apertures of the pod support, and bringing the reservoir to the open state, paintballs contained in the reservoir flow out the holes and into pods in the pod support. Stray paintballs are caught by the housing rather than spilled.

In certain embodiments, a system for filling at least one pod with paintballs comprises a housing, a pod support, a reservoir, and a valve. The pod support is configured to fit within the housing and maintain at least one pod in a substantially vertical orientation in the housing. The reservoir may store a plurality of paintballs. The reservoir is configured to couple to the housing. The reservoir has at least one opening positioned in a bottom wall so that the opening may be aligned with at least one pod in the pod support. The valve is movable between a first position in which the at least one opening in the reservoir is at least partially obstructed and a second position in which said opening is unobstructed to permit the controlled flow of paintballs from the reservoir to the at least one pod supported in the pod support.

In other embodiments, a system for filling at least one pod with paintballs comprises a housing, a pod support, and a reservoir. The pod support is configured to fit within the housing and maintain at least one pod in a substantially vertical orientation in the housing. The reservoir may store paintballs. The reservoir is configured to couple to the housing. The reservoir can be selectively switched between an open state where paintballs contained within the reservoir may pass through at least one hole in a bottom wall of the reservoir and a closed state where paintballs contained within the reservoir may be blocked from passing through the holes.

In still other embodiments, a paintball refilling device for simultaneously filling a plurality of paintball pods comprises a reservoir and a valve. The reservoir comprises a plurality of holes in a bottom surface thereof. The valve is attached to the reservoir and configured to be movable between a first position in which the plurality of holes are at least partially obstructed and a second position in which the plurality of holes are substantially unobstructed. The reservoir is configured to detachably couple to the plurality of paintball pods.

In other embodiments, a method of filling at least one paintball pod comprises the steps of filling a reservoir with a plurality of paintballs, positioning at least one paintball pod in a pod support, and selectively controlling the flow of paintballs from the reservoir to the at least one paintball pod in the pod support. The method may additionally comprise the step of positioning the pod support in a housing.

DETAILED DESCRIPTION OF THE PREFERRED EMBODIMENT

Systems, devices, and methods for simultaneously filling at least one paintball pod with a plurality of paintballs while reducing the incidence of spilled paintballs are disclosed. With reference FIGS. 1-4 aspects of various preferred embodiments of paintball filling systems are illustrated.

Figure 1:
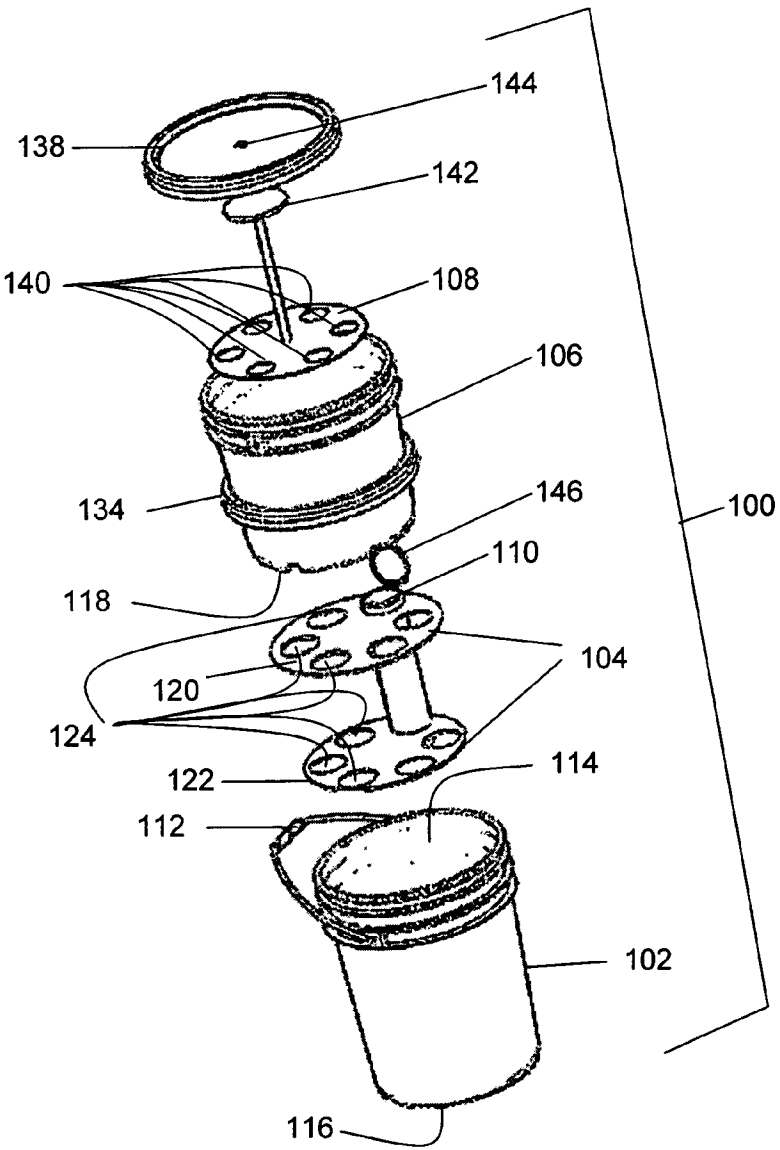
FIG. 1 is an exploded perspective view of a paintball filling system.
Figure 2:
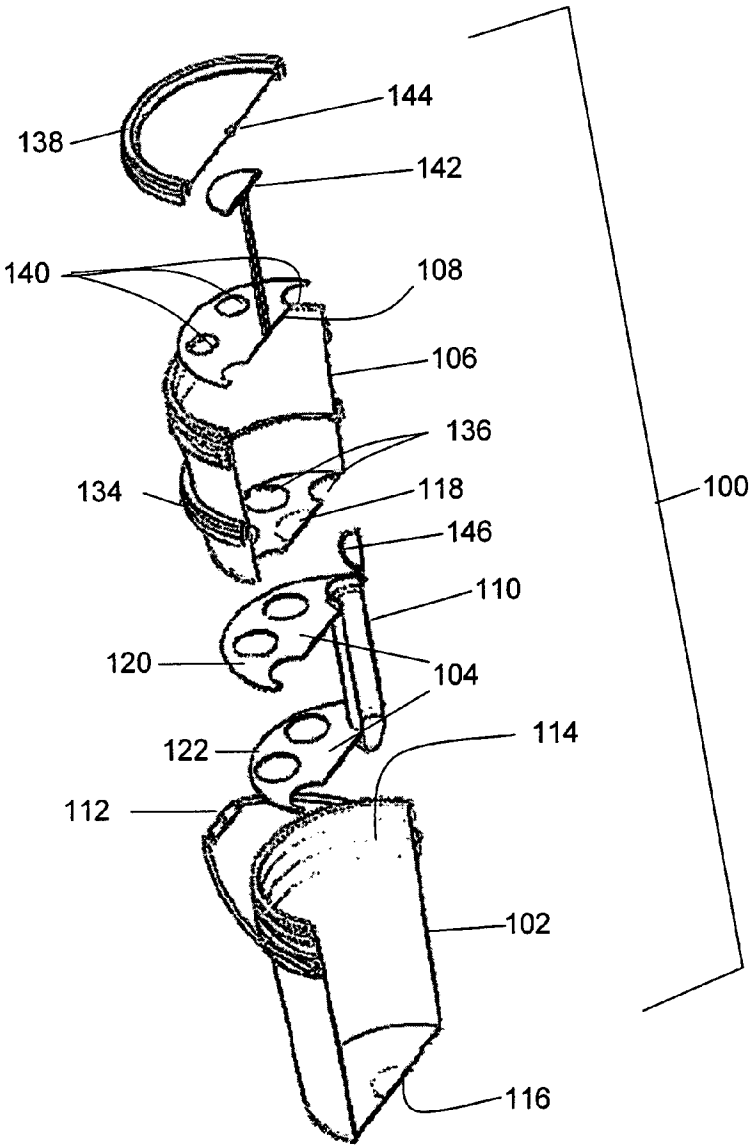
FIG. 2 is a cut away exploded perspective view of the paintball filling system of FIG. 1.

As depicted in FIGS. 1 and 2, a paintball filling system 100 comprises a housing 102, a pod support 104, a reservoir 106 for storing a plurality of paintballs, and a valve 108 for selectively controlling a flow of paintballs from the reservoir 106. The pod support 104 is configured to support at least one paintball pod 110 and retain it in a substantially vertical orientation within the housing 102. The reservoir 106 is configured to couple to the housing 102 such that the paintball filling system 100 is easily transportable as a single unit. The paintball filling system 100 may include a handle 112 to facilitate its transportability.

Housing

In the depicted embodiments, the housing 102 may comprise a conventional bucket, i.e., a generally cylindrical container with an open upper surface 114. This generally cylindrical shape contributes to the efficient storage of several paintball pods 110. As depicted, the housing 102 is sized and configured to house at least six paintball pods 110. However, the housing 102 could be sized and configured to hold more or fewer paintball pods 110. It is recognized that other housing shapes and sizes may be used in a paintball filling system as described herein. The size and number of paintball pods 110 to be contained therein may be a consideration in selecting the size and shape of the housing 102.

Additionally, the housing 102 may be configured with a substantially flat lower base 116 such that it can stand on relatively level surfaces such as level ground, a floor, a shelf, a bench, or a table. Thus, the shape of the housing 102 would allow the paintball filling system 110 to be used in a wide range of locations. Although a paintball filling system housing could be restrainably mounted to a pole, a table, or other mounting location such as by rope, elastic band, adhesive, clamp, fastener, bracket or other mounting device, it need not be to permit portability.

The housing 102 is preferably constructed of a material that is lightweight, low cost, and easily manufacturable. Various metals, plastics, and polymers may be suitable for the material of the housing 102. The housing 102 may be configured to be transportable such that all of the components of the paintball filling system 100 may be placed in or nested with the housing 102 and easily carried by one person. To enhance the portability of the housing 102, it may comprise a handle 112, finger grips, or another carrying feature. Advantageously, this portability would allow a paintball player to easily carry the paintball filling system 100 where desired to refill paintball pods 110.

The housing 102 may include an open upper surface 114 that is configured to couple to a bottom wall 118 of a reservoir 106 as further discussed below. The housing 102 may also include a shoulder on an inner surface that is configured to support a pod support 104 as further described below. Alternately, the housing 102 may include a pod support formed of an inner surface of the housing 102.

Pod Support

In certain embodiments, paintball filling systems 100 also include a pod support 104 configured to maintain at least one paintball pod 110 in a substantially vertical orientation within the housing 102. Orienting the paintball pod 110 in a substantially vertical position allows a gravity feed of paintballs. The pod support 104 is also configured to maintain the position of the paintball pod 110 within the housing 102. In embodiments where the pod support 104 accepts a plurality of paintball pods, the pod support 104 maintains the positions of those pods relative to each other.

With reference to FIGS. 1 and 2, in certain embodiments, the pod support 104 comprises a first plate 120 and a second plate 122, each including at least one aperture 124 through which a paintball pod may be inserted. The apertures 124 on each of the plates 120, 122 are aligned so that a paintball pod 110 may be inserted through the first plate 120 and the second plate 122. The paintball pod 110 may be slid into an aperture 124 of the first plate 120, and the first plate 120 may then be advanced to an upper position on the paintball pod 110. The paintball pods 110 may have flared upper ends such that the plates 120, 122 will not pass over the upper ends of the paintball pods 110. The second plate 122 is then advanced over a lower portion of the paintball pod 110 and advanced into a lower position on the paintball pod. The plates 120, 122 are shaped and configured to fit within the housing 102. Thus, when both plates 120, 122 and at least one pod 110 are placed in the housing 102, the pod 110 is maintained in a substantially vertical orientation. As illustrated, the plates 120, 122 may be circular or other shape, but should have a diameter that is smaller than the inner diameter of the housing 102. The housing 102 may include one or more shoulders on an inner surface to allow at least one or both of the pod support plates 120, 122 to rest on the shoulder(s). The pod support plates 120, 122 and inner shoulder(s) may be sized such that one of the pod support plates 120, 122 may lowered into the housing 102 below the shoulder.

Figure 3:
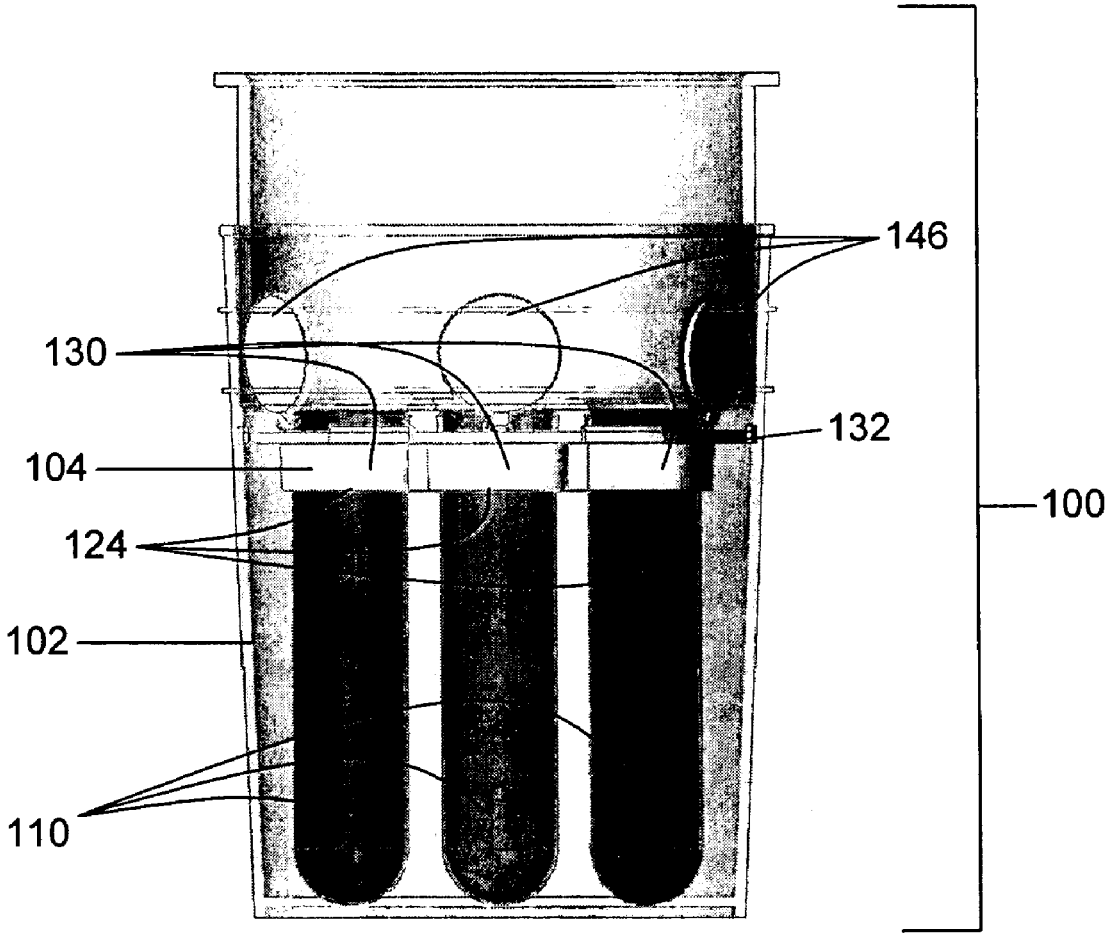
FIG. 3 is a cut away side view of a paintball filling system assembled for filling paintball pods.
Figure 4:
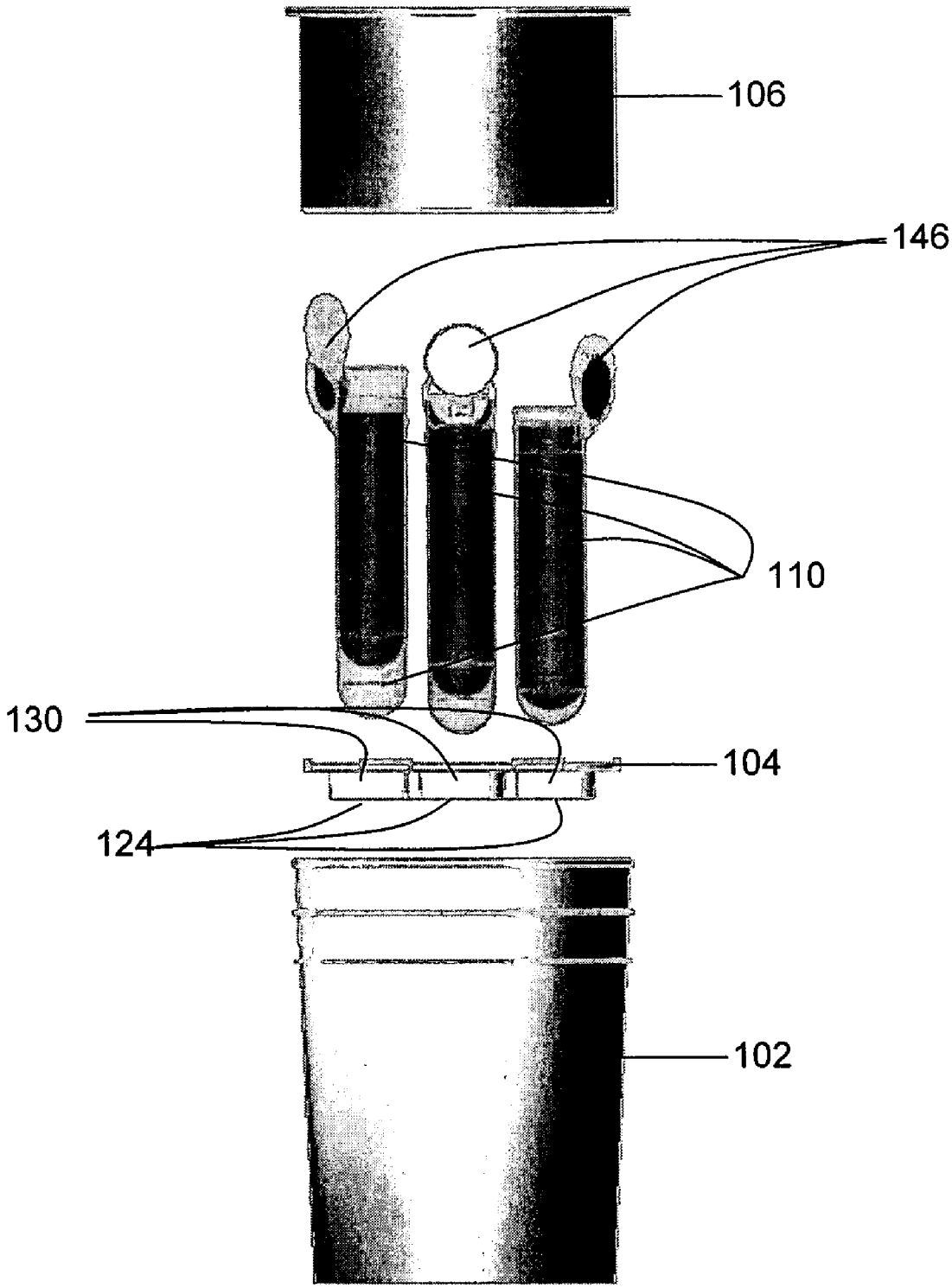
FIG. 4 is an exploded view of the paintball filling system of FIG. 3.

With reference to FIGS. 3 and 4, an alternative embodiment of pod support 104 comprises one plate including at least one aperture 124 to allow insertion of a paintball pod 110 therethrough. The pod support 104 may include a sidewall 130 extending around the at least one aperture 124 to enhance the substantially vertical support of the pod support 104. Advantageously, these sidewalls 130 retain a paintball pod 110 stored in the housing 102 in a substantially vertical orientation even when the housing 102 is disturbed by transporting motions of the paintball filling system 100 such as bumping, shaking, or other movement. The housing 102 may include a stop 132 on an inner wall configured to allow the pod support 104 to rest in the housing 102.

The pod support 104 of the embodiments illustrated herein have been described as comprising a discrete component or components. However, it is contemplated that in certain embodiments the pod support 104 may be integrally formed with an interior surface of the housing 102. Additionally, while the embodiments of pod support 104 have been illustrated herein as comprising substantially circular plates, it is contemplated that plates of other geometries or non-plate structures could be used. For example, a pod support 104 comprising a substantially square plate may be used in conjunction with a cylindrical or non-cylindrical housing 102.

Reservoir

With reference to FIG. 1, the reservoir 106 may be a relatively large vessel for holding a plurality of paintballs. The reservoir 106 may be sized with a paintball capacity that is preselected for the desired usage of the paintball filling system. For example, a large capacity reservoir may be desirable for team play where the reservoir will likely be used to fill multiple players' paintball pods. Smaller capacity reservoirs may be desirable where the paintball filling system is configured to be used by a single player. Portability is contemplated regardless of size.

Typically, paintballs are commercially available in bulk amounts such as 500, 1000, or 2000 paintball cases or bags. In certain embodiments, the reservoir 106 is sized to hold one or more bags or cases of paintballs. Thus a reservoir 106 may be sized to hold 500, 1000, or multiple thousands of paintballs. Advantageously, such a configuration facilitates easy loading of the reservoir 106 as a bag of paintballs can be opened and completely emptied into the reservoir 106.

In other embodiments, the reservoir 106 may be sized to hold approximately enough paintballs to fill the paintball pods 110 capable of being held in the pod support 104 of the paintball filling system 100. For example, the illustrated embodiments depict a pod support 104 capable of holding six pods 110 to be filled. If the paintball pods 110 each hold one-hundred paintballs, a reservoir 106 could be sized to hold approximately 600 paintballs. It may be desirable for the reservoir 106 to have a slightly higher capacity to account for the possibility of paintball breakage during transport or reloading operations. Advantageously, this single-fill capacity-matched configuration of reservoir 106 would allow the paintball filling system 100 to be as small and light as practical to allow one full reload of a predetermined number of paintball pods 110, thus, providing a high degree of portability of the paintball filling system 100.

With reference to FIGS. 1-4, the reservoir 106 may be a generally cylindrical vessel having a bottom wall 118 that is configured to couple to a generally cylindrical housing 102. It is recognized, however, that in other embodiments, the reservoir 106 may have a different shape. The shape of the reservoir 106 may be chosen to address various considerations including: portability, paintball capacity, the number and arrangement of paintball pods to be filled, ease of manufacture, and other considerations.

With reference to FIGS. 1 and 2, in certain embodiments, the reservoir 106 may comprise a collar 134 on an outer surface thereof. The collar 134 is configured to couple to an upper surface of the housing 102. The collar 134 may be positioned above the bottom wall 118 of the reservoir 106 to allow the bottom wall 118 of the reservoir 106 to extend into the housing 102 when the reservoir 106 is placed on or coupled with the housing 102.

As illustrated in FIG. 2, the reservoir 106 comprises at least one opening 136 in the bottom wall 118 thereof. The opening 136 is alignable with at least one aperture 124 in the pod support 104 when the reservoir 106 is coupled with the housing 102. Desirably, the reservoir 106 comprises a plurality of openings 136 in the bottom wall 118 that can be aligned with a plurality of apertures 124 in the pod support 104. In the illustrated embodiments, the reservoir 106 comprises at least six openings 136 in the bottom wall 118. The openings 136 in the reservoir 106 are positioned relative to each other such that they are alignable with the six apertures 124 in the pod support 104 when the reservoir 106 is positioned over the pod support 104, such as, for example, when the reservoir 106 is coupled with the housing 102 containing the pod support 104. Thus, in the illustrated embodiments, when the reservoir 106 is place in or coupled with the housing 102, a flow of paintballs from the reservoir 106 out of the openings 136 would simultaneously fill all of the paintball pods 110 retained in the pod support 104.

Alternatively, the reservoir 106 may have more or fewer openings that the pod support 104 has apertures 124. With such an alternative configuration, either some, but not all, of the pods retained in the pod support 104 could be filled in a single paintball flow (if there were fewer openings in the reservoir 106 than paintball pods in the pod support 104), or the paintballs would flow into the housing 102 in addition to simultaneously filling the paintball pods in the housing 102 (if there were more openings in the reservoir 106 than paintball pods in the pod support 104). It is contemplated that each opening 136 may be collectively (together with all of the other openings 136), groupingly (together with at least one other opening 136), or individually controllable to permit the flow of paintballs therethrough.

As illustrated in FIGS. 1 and 2, in certain embodiments, the reservoir 106 may include a lid 138. The lid 138 may be removably attached to an upper edge of the reservoir 106 by, for example, a mating tongue-in-groove structure similar to those commonly employed in resealable food containers. Advantageously, the lid 138 facilitates the portability of a paintball filling system for a player engaged in a paintball game as, with the lid 138 secured closed, the reservoir 106 could be oriented at any angle relative to vertical without spilling paintballs. Furthermore, a relatively large lid 138 allows easy, rapid filling of the reservoir 106 from a bulk bag or case of paintballs with little spillage of paintballs.

Valve

With reference to FIGS. 1 and 2, the paintball filling system 100 preferably comprises a valve 108 having one of a variety of possible sizes and configurations. The valve 108 allows a user to selectively control a flow of paintballs from the reservoir 106. The valve 108 is movable between a first position in which the at least one opening in the reservoir 106 is at least partially obstructed and a second position in which said opening is sufficiently unobstructed to permit a paintball therethrough. Thus, the actuation of the valve 108 from the first position to the second position permits the controlled flow of paintballs from the reservoir 106 to the at least one pod supported in the pod support 104

As shown in the illustrated embodiments, the valve 108 may comprise a substantially circular plate having one or more holes 140 therethrough. The substantially circular plate is rotatable with respect to the reservoir 106 such that the holes 140 in the valve 108 can be aligned with the openings 136 in the bottom wall 118 of the reservoir 106. When in alignment, the valve 108 is considered to be in the second position. With the valve 108 in this second position, paintballs contained in the reservoir 106 may flow through one or more of the openings 136 in the bottom wall 118 of the reservoir 106. When the holes 140 in the valve 108 are out of alignment with the openings in the reservoir 106, the valve 108 is in the first position, and the flow of paintballs from the reservoir 106 is precluded. While the valve 108 in the illustrated embodiments is depicted as comprising a circular plate, it is contemplated that other configurations of valve 108 could be used in a paintball filling system 100. For example, the valve 108 could be a plate of a different shape with holes, a hub with a plurality of radial extensions configured to block openings 136 in the reservoir 106, or another structure that is movable to block one or more openings 136 in the reservoir 106 to selectively control the flow of paintballs from the reservoir 106.

Additionally, it is contemplated that valve 108 may comprise a plurality of holes 140 positioned such that in addition to the first and second positions, the valve 108 is movable to a third position in which a flow of paintballs is unobstructed through at least one, but not all of the openings in the reservoir 106. Advantageously, such a valve 108 configuration could allow a user to selectively control the flow of paintballs from the reservoir 106, for example, by setting the valve to the third position to fill a single paintball pod 110 or a select group of pods 110 while other openings 136 of the reservoir 106 are obstructed by the valve 108.

With reference to FIG. 1, the valve 108 of this embodiment is rotatably coupled to the reservoir 106. As illustrated, the valve 108 may be rotatably mounted to an inner surface of the bottom wall 118 of the housing 102. Valve 108 could also be rotatably mounted to a different location on the reservoir 106 such as, for example, an exterior surface of the bottom wall 118 of the reservoir 106. It is further contemplated that the reservoir 106 and valve 108 could be configured to be slidably coupled rather than rotatably coupled, or other moving relationships that permit the user to collectively or selectively control paintball flow.

With further reference to FIG. 1, the valve 108 comprises a control grip 142 to control actuation of the valve 108. In the embodiment shown, the grip 142 is operatively coupled to the substantially circular plate such that movement of the control grip 142 rotates the valve 108 relative to the reservoir 106. Thus, movement of the control grip 142 rotates the valve 108 between the first position and the second position, or other positions if so configured. The lid 138 may include an opening 144 therein such that the control grip 142 or a structure operatively coupling the control grip 142 to the valve 108 may extend through the lid 138.

In the illustrated embodiments, the valve 108 is a substantially circular plate including at least six holes 140 therethrough and positioned such that they are alignable with the six openings in the lower surface of the reservoir 106. The six openings in the lower surface of the reservoir 106 are likewise alignable with six apertures in the pod support 104. Thus, with the reservoir 106 loaded with a plurality of paintballs and the valve 108 in the first position to obstruct the flow of paintballs from the reservoir 106, the reservoir 106 may be coupled with the housing 102 such that the openings 136 in the bottom wall 118 of the reservoir 106 align with the apertures 124 in the pod support 104 in the housing 102. A user may then move the control grip 142 to rotate the valve 108 into the second position, commencing a flow of paintballs from the reservoir 106 into all of the paintball pods 110 retained in the pod support 104.

While the illustrated embodiments include a user-actuated valve 108 comprising a control grip 142, one of skill in the art will appreciate that in other embodiments, a flow of paintballs from the reservoir 106 to paintball pods 110 may be selectively controlled by rotating the reservoir 106 relative to the housing 102. For example, the reservoir 106 could be placed atop the housing 102 and rotated relative to the housing 102 to align apertures to initiate a flow of paintballs from the reservoir 106.

Operation of the Paintball Filling System

The paintball filling systems 100 described above can be used to rapidly fill one or more paintball pods 110. The present invention also comprises a method of filling at least one paintball pod that comprises the steps of filling a reservoir 106 with a plurality of paintballs, positioning at least one paintball pod 110 in a pod support 104, and selectively controlling the flow of paintballs from the reservoir 106 to the at least one paintball pod in the pod support 104.

With reference to FIG. 1, the reservoir 106 of a paintball filling system can be filled with a plurality of paintballs by removing the lid 138 from the reservoir 106 and at least partially emptying a bag or case of paintballs into the open reservoir 106. Once the reservoir 106 has been filled to a desired level with paintballs, the lid 138 may be replaced. Advantageously, in the illustrated embodiments, the reservoir 106 includes a relatively wide opening, covered by a relatively wide removable lid 138. This wide opening reduces the incidence of paintball spillage during the filling of the reservoir 106 from a bulk paintball container. Preferably, the lid 138 can be coupled to the reservoir 106 such as by a tongue-in-groove interface such that, when the lid 138 is replaced on the reservoir 106, the lid 138 will remain in position even when the filled reservoir 106 is shaken, dropped, turned upside down, or otherwise subjected to sudden movements while being transported or carried during paintball gameplay.

With reference to FIG. 3, at least one paintball pod 110 is positioned in a pod support 104. As discussed above, the pod support 104 is configured to maintain the paintball pod 110 in a substantially vertical orientation. This vertical orientation allows gravity feed of paintballs from the reservoir 106 to the pod 110. The pod support 104 may be positioned in a housing 102. Alternatively, the pod support 104 may be integrally formed with an interior surface of the housing 102.

Flow of the plurality of paintballs from the reservoir 106 to the at least one pod in the pod support 104 may be selectively controlled. With respect to FIGS. 1 and 2, in the illustrated embodiments, actuation of the valve 108 rotatably coupled to the reservoir 106 controls the flow of paintballs from the reservoir 106. As described above, the valve 108 may be actuated by movement of a control grip 142. Alternately, the reservoir 106 may be configured such that flow of paintballs is automatically initiated by coupling at least one paintball pod 110 to the reservoir 106.

In the illustrated embodiments, the reservoir 106 containing the plurality of paintballs must be coupled with the housing 102, which contins the pod support 104 and at least one paintball pod 110, before a flow of paintballs is initiated by actuating the valve 108. This engagement of the housing 102 with the reservoir 106 preferably includes aligning the openings in the reservoir 106 with the apertures in the pod support 104 such that, once a flow of paintballs from the reservoir 106 is initiated, the paintballs will be released directly over a pod 110 in the pod support 104.

With reference to FIG. 3, in order for the paintball pod 110 to receive the flow of paintballs, a cap 146 of the paintball pod 110 should be opened before flow is initiated. In the illustrated embodiments, the housing 102 and the reservoir 106 are sized and configured such that the cap 146 of the at least one paintball pod 110 fits in a clearance formed when the housing 102 is coupled to the reservoir 106.

Once the flow of paintballs from the reservoir 106 has been initiated, the flow continues until the reservoir 106 has been emptied, the paintball pods 110 have been filled, or the flow has been selectively terminated. Because the openings 136 on the bottom wall 118 of the reservoir 106 can be aligned with the paintball pods 110 in groups or their entirety, multiple paintball pods 110 are simultaneously filled by the flow of paintballs. If, as shown in FIGS. 1 and 2, fewer than all of the apertures 124 in the pod support 104 have been loaded with paintball pods 110, paintballs will flow from the openings 136 in the reservoir 106 both into the pods 110 loaded in the pod support 104 and through the empty apertures of the pod support 104. Advantageously, in the illustrated embodiments, the housing 102 collects paintballs flowing into the empty apertures. Additionally the housing 102 catches other stray paintballs that may otherwise have been spilled during a filling session. Thus, these paintballs have not been contaminated by ground contact and may be retrieved and used.

Once the pods 110 have been sufficiently filled with paintballs, the valve 108 may be actuated to obstruct the openings 136 in the bottom wall of the reservoir 106. The reservoir 106 may then be removed or decoupled from the housing 102 and the filled paintball pod 110 removed from the pod support 104 and its cap 146 closed. The entire paintball pod filling process may be repeated, if desired, to fill additional paintball pods. Accordingly, many paintball pods 110, such as may be desirable to outfit several members of a paintball team, may be filled quickly and efficiently with reduced risks of costly spillage.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Further, the various features of this invention can be used alone, or in combination with other features of this invention other than as expressly described above. Thus, it is intended that the scope of the present invention herein disclosed should not be limited by the particular disclosed embodiments described above, but should be determined only by a fair reading of the claims that follow.

What is claimed is:

1. A system for filling at least one pod with paintballs, the system comprising:

a housing;

a pod support configured to fit within the housing and maintain at least one pod in a substantially vertical orientation in the housing;

a reservoir for storing a plurality of paintballs, the reservoir configured to couple to the housing, said reservoir having at least one opening positioned in a bottom wall so that the opening may be aligned with at least one pod in the pod support; and a valve movable between a first position in which the at least one opening in the reservoir is at least partially obstructed and a second position in which said opening is unobstructed to permit the controlled flow of paintballs from the reservoir to the at least one pod supported in the pod support, wherein the housing comprises a substantially cylindrical container having an open top end, wherein the pod support comprises a plate having a plurality of apertures configured to support a corresponding number of pods, wherein the bottom wall of the reservoir comprises a corresponding number of openings positioned to align with the apertures of the pod support when the reservoir is coupled to the housing, wherein the valve is configured to control the flow of paintballs from the reservoir into the plurality of pods simultaneously, and wherein the valve comprises a substantially circular plate having a plurality of holes therethrough.

2. The system of claim 1, wherein the valve comprises a control grip connected to the substantially circular plate such that movement of the control grip results in rotation of the valve relative to the reservoir.

3. A system for filling at least one pod with paintballs, the system comprising:

a housing;

a pod support configured to fit within the housing and maintain at least one pod in a substantially vertical orientation in the housing;

a reservoir for storing paintballs configured to couple to the housing, wherein the reservoir can be selectively switched between an open state where paintballs contained within the reservoir may pass through at least one hole in a bottom wall of the reservoir and a closed state where paintballs contained within the reservoir may be blocked from passing through the holes; and a valve rotatably connected to the reservoir such that rotation of the valve from a first position to a second position switches the reservoir from the open state to the closed state.

4. A paintball pod refilling device for simultaneously filling a plurality of paintball pods, the device comprising:

a reservoir comprising a plurality of holes in a bottom surface thereof; and a valve attached to the reservoir and configured to be movable between a first position in which the plurality of holes are at least partially obstructed and a second position in which the plurality of holes are substantially unobstructed;

wherein the reservoir is configured to detachably couple to the plurality of paintball pods; and wherein the valve comprises:

a generally circular plate engageable with the reservoir; and a plurality of apertures that are alignable with the plurality of holes of the reservoir.

5. The device of claim 4, wherein the plurality of holes comprises six holes and the plurality of apertures comprises six apertures.

* * * * *